US005715626A

United States Patent [19]

Scaramucci

[11] Patent Number: 5,715,626

[45] Date of Patent: Feb. 10, 1998

[54] INTERCHANGEABLE RIB ASSEMBLY FOR RIFLES

[75] Inventor: Sergio Scaramucci, Gallo Di Petriano, Italy

[73] Assignee: Benelli Armi S.P.A., Urbino, Italy

[21] Appl. No.: 573,556

[22] Filed: Dec. 15, 1995

[30] Foreign Application Priority Data

Dec. 16, 1994 [IT] Italy ..... MI94A2539

[51] Int. Cl.[6] ..... F41G 1/42

[52] U.S. Cl. ..... 42/102; 33/233

[58] Field of Search ..... 42/102, 100; 33/233

[56] References Cited

U.S. PATENT DOCUMENTS

| | | | |
|---|---|---|---|
| 1,160,157 | 11/1915 | Flues | 42/102 |
| 2,620,583 | 12/1952 | Simmons | 42/102 |
| 2,669,052 | 2/1954 | Simmon | 42/102 |
| 3,005,263 | 10/1961 | Lockwood | 42/102 |
| 3,107,450 | 10/1963 | Snyder et al. | 42/102 |
| 3,325,937 | 6/1967 | Morrow | 42/102 |
| 3,556,889 | 1/1971 | Grahn | 33/233 |
| 4,000,574 | 1/1977 | Grant | 42/100 |
| 4,143,465 | 3/1979 | White | 33/233 |
| 4,524,670 | 6/1985 | Billard et al. | 89/1.53 |
| 4,878,308 | 11/1989 | Rose | 42/102 |

FOREIGN PATENT DOCUMENTS

| | | | |
|---|---|---|---|
| 1268890 | 9/1960 | France | 42/102 |
| 4026483 | 11/1991 | Germany | 42/100 |

*Primary Examiner*—Stephen M. Johnson
*Attorney, Agent, or Firm*—McAulay Fisher Nissen Goldberg & Kiel, LLP

[57] ABSTRACT

An interchangeable rib assembly for rifles includes engagement portions (207) adapted to cooperate with respective posts (205) provided on the barrel (203) of a rifle so as to detachably fix the rib to the barrel. The rib can be advantageously made of plastic, carbon fiber, or the like, and have different shapes, each shape being appropriate for the contingent requirements (hunting, target practice, et cetera).

2 Claims, 6 Drawing Sheets

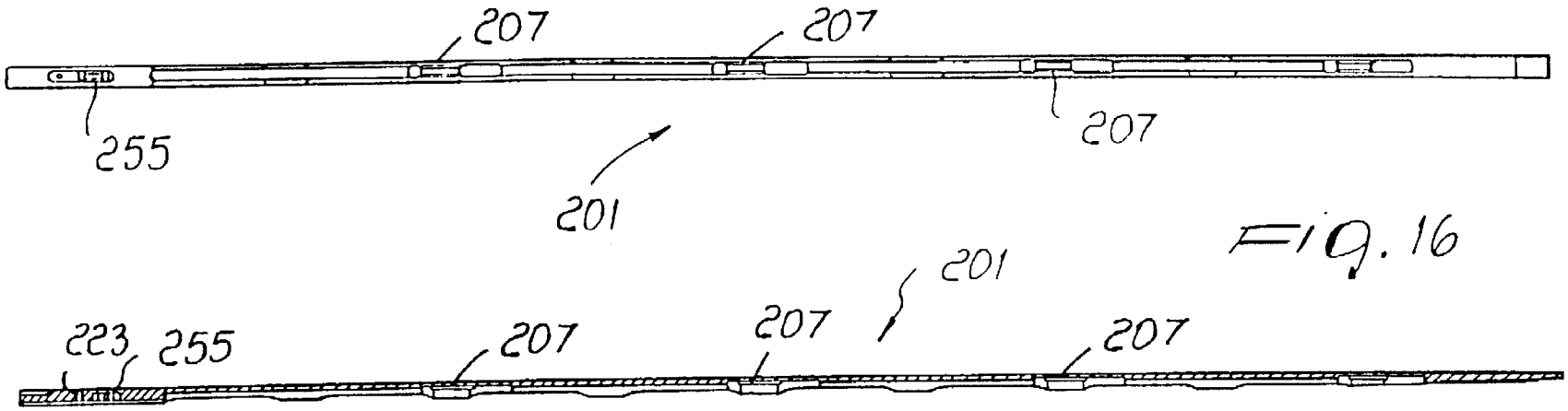
Fig. 16
Fig. 17
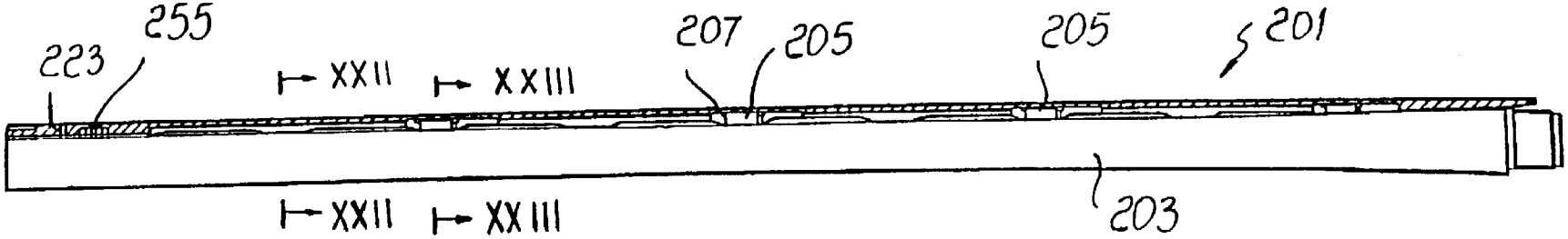
Fig. 18

INTERCHANGEABLE RIB ASSEMBLY FOR RIFLES

BACKGROUND OF THE INVENTION

1. Field of the Invention

The present invention relates to an interchangeable rib assembly for rifles.

2. Description of the Prior Art

Sighting ribs are generally applied to semiautomatic rifles, and to rifles having two superimposed barrels, with the purpose of aiming more precisely by facilitating the visualization of the aiming line.

These ribs are often knurled to reduce reflection and glare.

It has been observed that ribs of different type should be applied according to the user's requirements and according to the specific circumstances (hunting, target practice, et cetera).

However, conventional ribs are usually permanently factory provided on the guns, by welding for example, and only in a few cases they can be substituted with a different type. The substitution however requires time and the professional skill of a gunsmith.

FR-A-1268890, for example, discloses a ventilated rib having a U shaped section and applied to the barrel of a rifle by means of profiled inserts associated with the barrel. The rib is welded to the profiled inserts and by this construction deformation of the barrel is prevented.

Also U.S. Pat. No. 2,620,583 discloses a ventilated sighting rib anchored firmly to a post, rigidly associated with the barrel, and longitudinally slidable relative to another post, whereby compensation is made for the unequal thermal expansion rates of said gun barrel and rib.

U.S. Pat. No. 4,000,574 and U.S. Pat. No. 3,556,889 disclose further systems for permanently mounting the rib on the barrel.

The aim of the present invention is to provide an interchangeable rib that can be disassembled and reassembled with an extremely quick and easy operation.

Within the scope of this aim, an object of the invention is to provide a rib that is particularly suitable to be made of light materials such as plastic, carbon fiber, or synthetic materials in general.

A further object of the invention is to provide a rib that can be easily industrialized.

Still a further object of the invention is to provide a rib that can be substituted even by a user lacking the professional skill of a gunsmith.

SUMMARY OF THE INVENTION

This aim, these objects and others, which will become apparent to those skilled in the art, are achieved by an interchangeable rib assembly for rifles, characterized in that it comprises a snap-action means adapted to cooperate with an anchoring means associated with a barrel of a rifle so as to detachably fix said rib to said barrel.

Further characteristics and advantages of the invention will become apparent from a reading of the detailed description of a preferred but not exclusive embodiment of an interchangeable rib assembly according to the invention, illustrated only by way of a non-limiting example in the accompanying drawings.

BRIEF DESCRIPTION OF THE DRAWINGS

FIG. 16 is a bottom view of the rib according to a third aspect of the invention;

FIG. 17 is a side section view of the rib of FIG. 16;

FIG. 18 is a side partial section view of the rib applied to a rifle barrel;

FIG. 24 is an enlarged partially cross section view of the barrel, according to lines XIV—XIV of FIG. 19.

DESCRIPTION OF THE PREFERRED EMBODIMENTS OF THE INVENTION

Figures 1, 2, 3, 4:
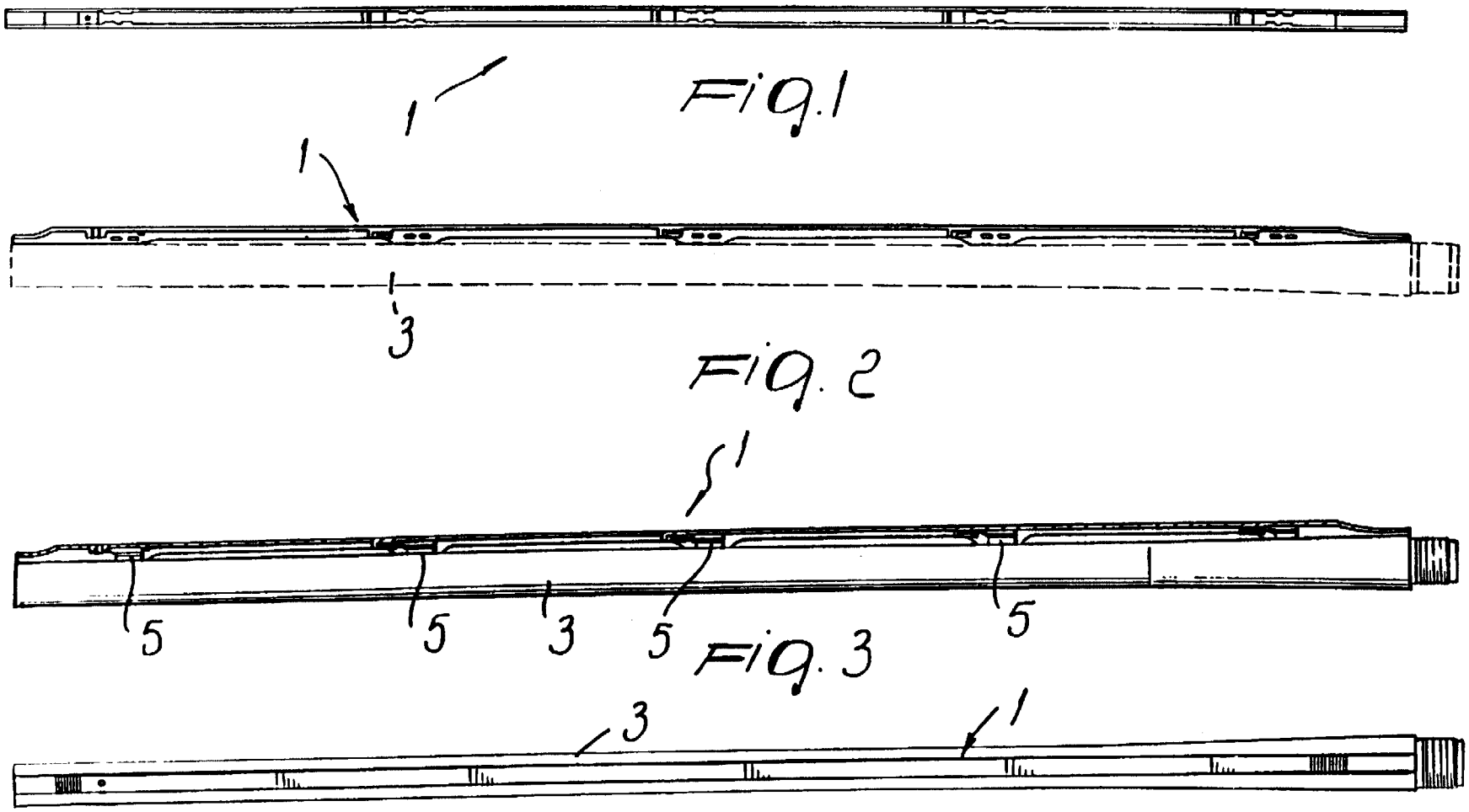
FIG. 1 is a bottom view of the rib according to a first aspect of the invention.
FIG. 2 is a side section view of the rib of FIG. 1.
FIG. 3 is a side partial section view of the rib applied to a rifle barrel.
FIG. 4 is a plan view of the rib of the preceding figures, applied to the rifle barrel.
Figure 5:
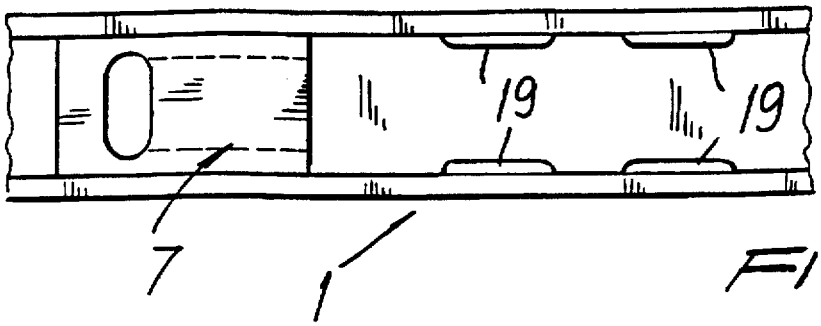
FIG. 5 is a partial enlarged-scale bottom view of the rib of the preceding figures.
Figure 6:
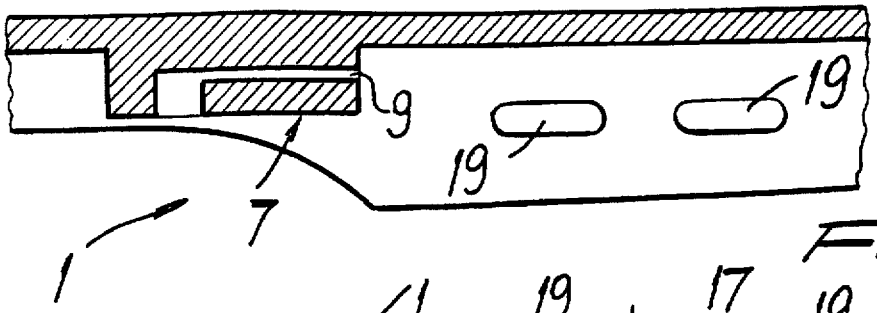
FIG. 6 is an enlarged-scale partial sectional side view of the rib of the preceding figures.
Figure 7:
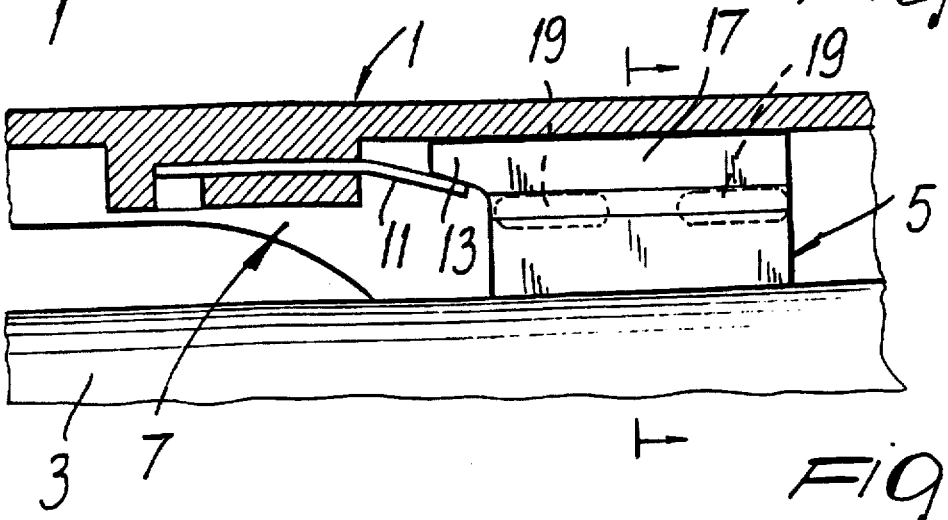
FIG. 7 is a view that is similar to the preceding one, with the rib applied to the barrel.
Figure 8:
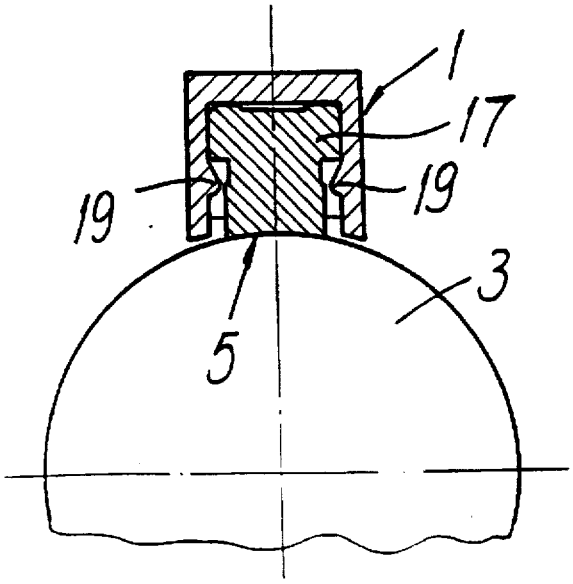
FIG. 8 is an enlarged-scale front sectional view of the rib.

With particular reference to FIGS. 1–8, the rib according to the invention, generally designated by the reference numeral 1, is suitable to be applied to a barrel 3 of a rifle, not shown, by means of a plurality of posts 5 fixed to the barrel itself.

Rib 1 is advantageously made of plastic and includes an engagement means constituted by a plurality of blocks 7, each having a slot 9 adapted to accommodate an elastic thin strip or blade 11.

Elastic blade 11 is adapted to engage a tooth 13 formed on each post 5.

Rib 1 also includes longitudinal ridges 19 which are adapted to engage below a wider upper portion 17, provided on each post 5.

The operation of the rib according to the invention is very simple: it is in fact sufficient to place the rib on the barrel, elastically deforming its sides so that ridges 19 pass beyond wider portion 17 of the posts, and so that blocks 7 are arranged in front of the respective posts. By then sliding the rib backward, blade 11 is engaged with tooth 13 of each post.

Figure 9:
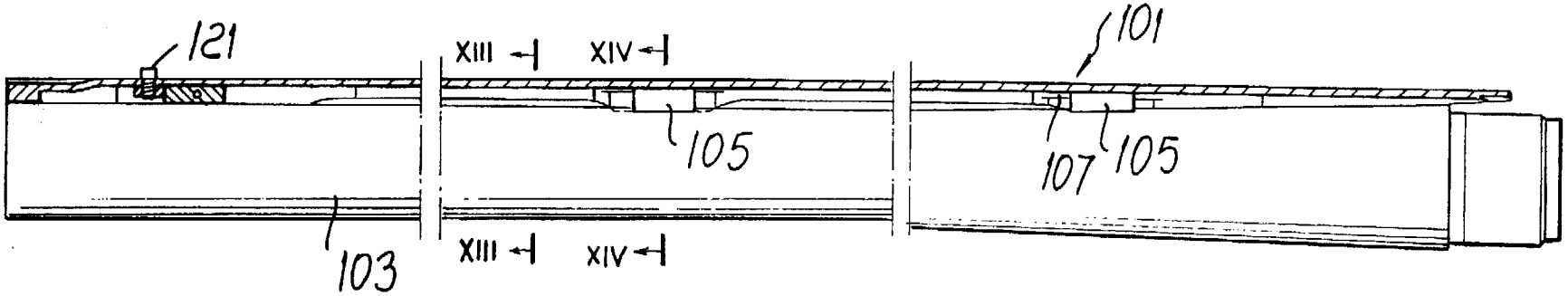
FIG. 9 is a lateral elevation view of the rib according to a second aspect of the invention, applied to a rifle barrel.
Figure 10:
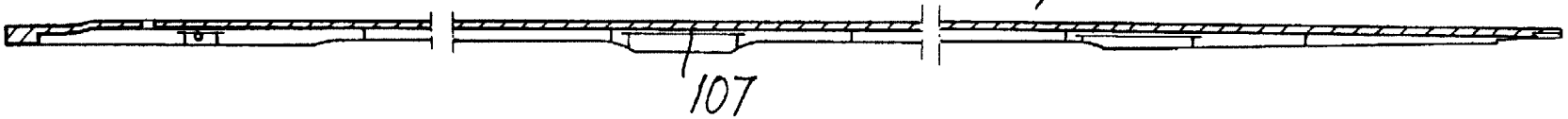
FIG. 10 is a sectional side view of the rib of FIG. 9.
Figure 11:
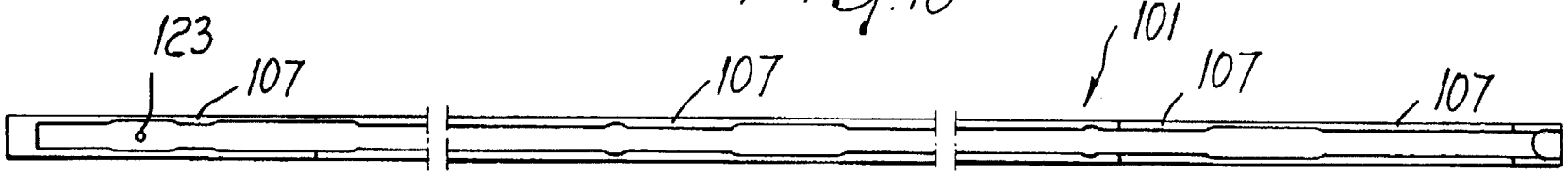
FIG. 11 is a bottom view of the rib of FIGS. 9–10.
Figure 12:
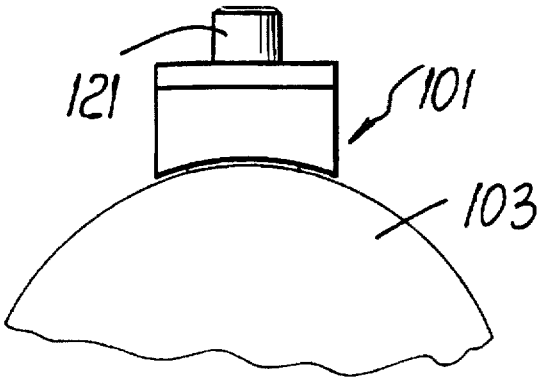
FIG. 12 is an enlarged-scale front view of the rib of FIGS. 9–11.
Figure 13:
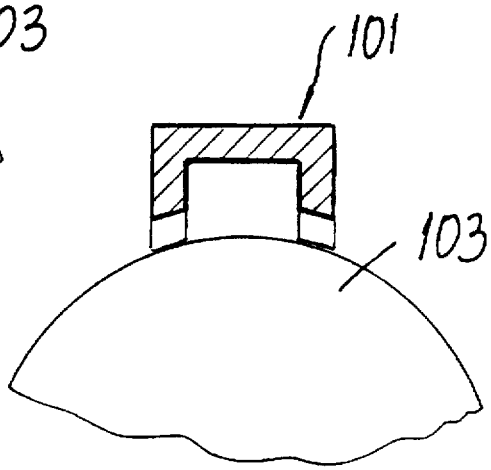
FIG. 13 is a sectional view, taken along the plane XIII—XIII of FIG. 9.
Figure 14:
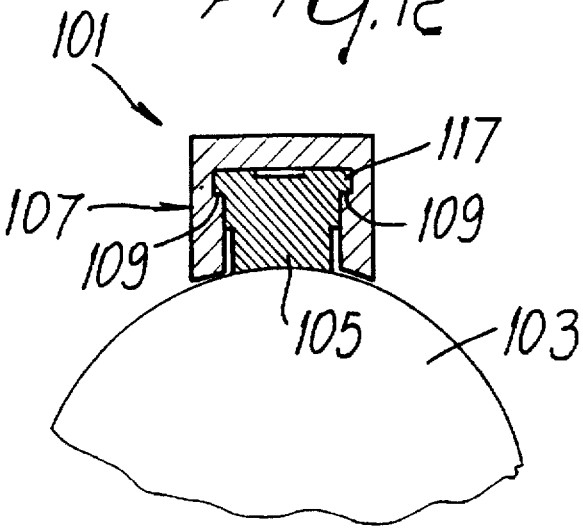
FIG. 14 is a sectional view, taken along the plane XIV—XIV of FIG. 9.
Figure 15:
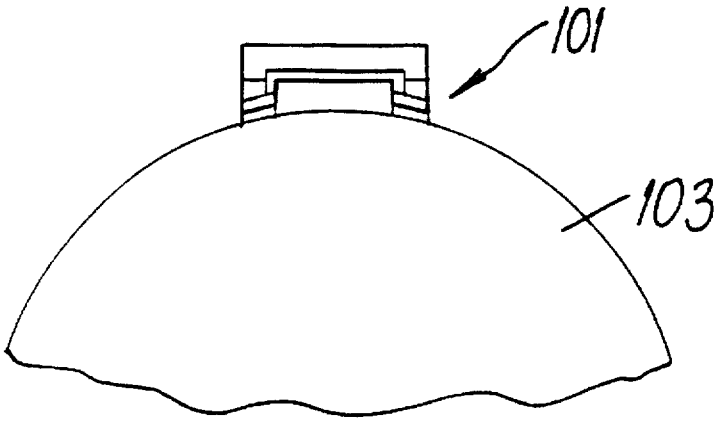
FIG. 15 is a rear view of the rib of FIGS. 9–14.

FIGS. 9–15 illustrate a rib 101, according to a further aspect of the invention, which is advantageously made of carbon fibers.

Rib 101 has a U-shaped cross-section and includes engagement portions 107 provided with an internal raised portion 109 that is adapted to engage a wider upper portion 117 of each post 105, provided on barrel 103.

To prevent the axial sliding of the rib, the front post is provided with a locking means, constituted for example by a screw or pin 121, that engages a hole 123 of rib 101.

Rib 101 can be mounted on the barrel with a quick and simple operation by placing the rib on the barrel so that engagement portions 107 are in front of the respective posts and then slide the rib backward to lock it.

Pin 121 ensures that the rib cannot slide during use.

Figure 19:
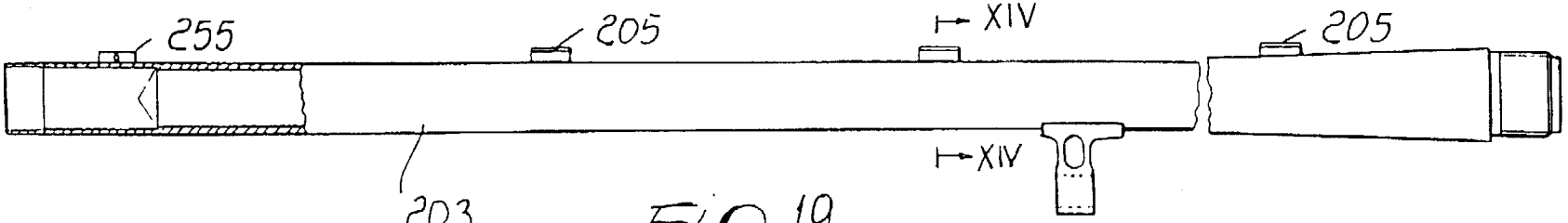
FIG. 19 is an enlarged side partial section view of the gun barrel of FIG.18.
Figure 20:
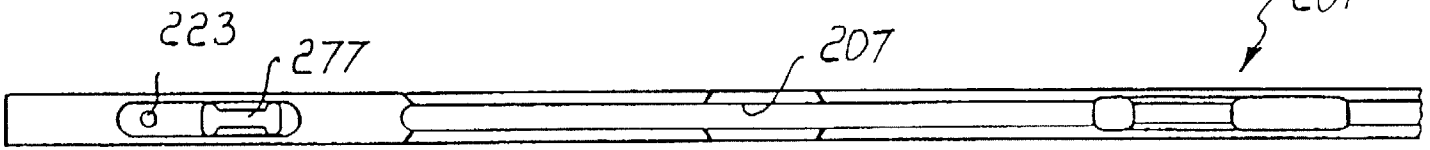
FIG. 20 is an enlarged bottom view of the rib of FIG. 16.
Figure 24:
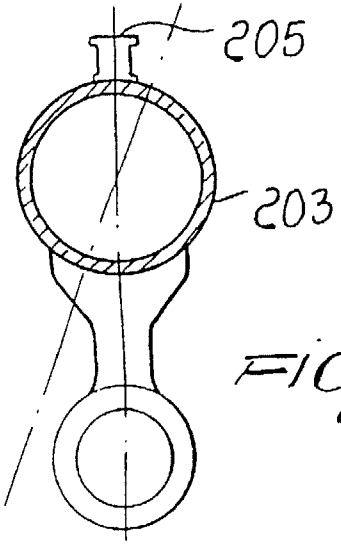
FIGS. 22–24 are enlarged cross section views respectively according to lines XXII—XXII, and XXIII—XXIII of FIG. 18.
Figure 23:
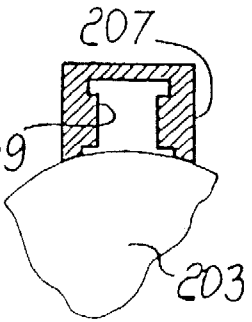
Figure 22:
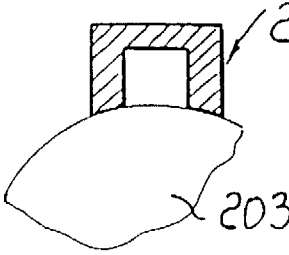
Figure 21:
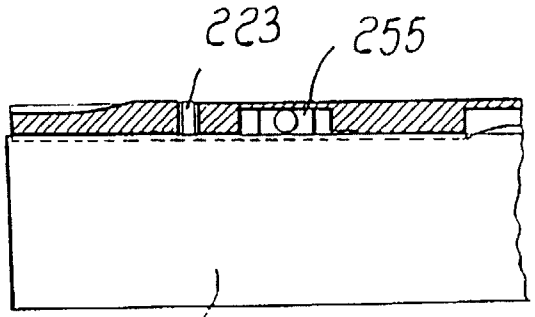
FIG. 21 is an enlarged longitudinal section view of the front part of FIG. 18.

FIGS. 16–24 illustrate a rib 201 according to still a further aspect of the invention.

Rib 201 is very similar to the above described rib 101, having a U-shaped cross-section and including engagement portions 207 provided with an internal raised portion 209 that is adapted to engage a wider upper portion 217 of each post 205, associated with barrel 203.

Unlike rib 101, however, rib 201 is prevented from sliding longitudinally on the barrel by a first post 255 which is snugly inserted in a seat 277 provided at the front portion of rib 201.

Rib 201 can be associated with posts 205 by elastically deforming the sides of the rib, for engaging engagement portions 207 on the T-shaped posts.

Front post 255 may be provided with a screw (not illustrated in the drawings) for preventing the front part of the rib from raising and possibly disengaging from front post 255.

The front portion of rib 201 is also provided with a hole 223 for the sight (not illustrated in the drawings) normally provided at the muzzle.

It has been observed in practice that the invention achieves the intended aim and objects, an interchangeable rib having been provided which can be applied to the barrel with an extremely simple and quick operation. The rib can of course be just as easily removed to be replaced with another one.

In this manner, the user can easily apply the most suitable rib to the contingent requirements (either hunting, target practice, et cetera).

The interchangeable rib assembly according to the invention is susceptible to numerous modifications and variations, all of which are within the scope of the inventive concept. All the details may furthermore be replaced with other technically equivalent elements.

In practice, the materials employed, as well as the dimensions, may be any according to the requirements.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended as limiting. The invention is limited only as defined in the following claims and the equivalents thereto.

I claim:

1. An interchangeable rib assembly for rifles, comprising a carbon fiber rib provided with snap-action means for engaging anchoring means on a rifle barrel in a snap-lock fit so as to detachably fix said rib to said barrel, said rib having elastically deformable sides for releasably coupling said snap-action means to said anchoring means, said anchoring means including a plurality of blocks fixed to said barrel, each of said blocks having a substantially T-shaped cross-section with a wider portion at a free end of the respective block, said rib having a U-shaped cross-section, said snap-action means including inwardly projecting elements on said sides, said projecting elements being engageable with respective ones of said blocks, between the wider portions thereof and said barrel.

2. The rib assembly defined in claim 1 wherein said rib also includes a seat provided at a front portion of said rib for snugly engaging a front post at a muzzle portion of said barrel to prevent a longitudinal sliding of said rib with respect to said barrel.

* * * * *